US007994458B2

(12) United States Patent
Geswender et al.

(10) Patent No.: US 7,994,458 B2
(45) Date of Patent: Aug. 9, 2011

(54) PROJECTILE HAVING FINS WITH SPIRACLES

(75) Inventors: Chris E. Geswender, Green Valley, AZ (US); Shawn B. Harline, Tucson, AZ (US); Nicholas E. Kosinski, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 453 days.

(21) Appl. No.: 12/257,690

(22) Filed: Oct. 24, 2008

(65) Prior Publication Data

US 2010/0102161 A1 Apr. 29, 2010

(51) Int. Cl.
*F42B 15/01* (2006.01)

(52) U.S. Cl. ..... 244/3.28

(58) Field of Classification Search ..... 244/3.24, 244/3.26–3.28; 89/385, 490
See application file for complete search history.

(56) References Cited

U.S. PATENT DOCUMENTS

| | | | |
|---|---|---|---|
| 3,622,103 | A | 11/1971 | Meier |
| 4,165,849 | A | 8/1979 | Fox |
| 4,546,940 | A | 10/1985 | Andersson et al. |
| 5,048,773 | A | 9/1991 | Washington et al. |
| 6,571,715 | B1 | 6/2003 | Bennett et al. |
| 6,978,967 | B1 | 12/2005 | Scheper et al. |

FOREIGN PATENT DOCUMENTS

| | | | |
|---|---|---|---|
| GB | 1322573 | A | 7/1973 |
| GB | 2274904 | A | 8/1994 |
| JP | 05149698 | | 6/1993 |

OTHER PUBLICATIONS

Amended claims from U.S. Appl. No. 12/257,699.
International Search Report and Written Opinion from corresponding International Application No. PCT/US09/51801.
International Preliminary Report on Patentability from corresponding International Application No. PCT/US09/51801.

*Primary Examiner* — Thomas Price
(74) *Attorney, Agent, or Firm* — Renner, Otto, Boisselle & Sklar, LLP

(57) ABSTRACT

A projectile has fins that are hingedly coupled to a fuselage. The fins are configured to wrap around the fuselage, assuming a location as close as possible to the fuselage, when the projectile is in a gun or launch tube. The fins have spiracles, one or more openings in each of the fins that allow pressurized gases to pass therethrough. The spiracles may be always open, or may open only when there is a sufficient pressure differential between the sides (major surfaces) of the fins. The spiracles allow release of pressurized gases that are trapped between the fins and the fuselage during the launch process. This prevents undesired outward movement or bending of the fins when the projectile reaches a muzzle brake during launch, a structure which causes a sudden release of pressure at radially outer locations of the launch tube.

21 Claims, 3 Drawing Sheets

PROJECTILE HAVING FINS WITH SPIRACLES

BACKGROUND OF THE INVENTION

1. Field of the Invention

The invention is in the field of projectiles launched form launch tubes or guns.

2. Description of the Related Art

Launching a projectile from a launch tube or gun requires as a practical matter that the projectile fit into a circular cross section tube. This makes it difficult to provide the projectile with fins, for example to stabilize the flight of the projectile. Many solutions have been tried to accommodate finned projectiles in guns or launch tubes, but no solution has been completely cost effective.

SUMMARY OF THE INVENTION

According to an aspect of the invention, a projectile has foldable fins each having one or more spiracles, openings to allow passage of pressurized gases trapped between the fins and a projectile fuselage.

According to another aspect of the invention, a method of relieving pressure trapped between foldable fins and a fuselage to which the fins are coupled, is to pass the gas through spiracles in the fins.

According to yet another aspect of the invention, a projectile includes: a fuselage; and fins hingedly coupled to the fuselage. Each of the fins has one or more spiracles in them to allow pressurized gasses to pass through a thickness of the fin.

According to still another aspect of the invention, a method of launching a projectile includes the steps of: providing the projectile having a fuselage and fins hingedly coupled to the fuselage, in a launch tube, with the fins in a compact configuration, folded against the fuselage; applying pressurized gases to a back end of the projectile, driving the projectile forward in the launch tube; and relieving pressurized gases in a space between the fins and the fuselage when the projectile reaches a muzzle brake of the launch tube.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, which are not necessarily to scale.

DETAILED DESCRIPTION

A projectile has fins that are hingedly coupled to a fuselage. The fins are configured to wrap around the fuselage, assuming a location as close as possible to the fuselage, when the projectile is in a gun or launch tube. The fins have spiracles, one or more openings in each of the fins that allow pressurized gases to pass therethrough. The spiracles may be always open, or may open only when there is a sufficient pressure differential between the sides (major surfaces) of the fins. The spiracles may be a series of small holes (vias) in the fins. Alternatively the spiracles may be larger openings, for example including one or more slits in the fin each mostly surrounding an area of the fin and acting as a flap, opening up by bending when subjected to a sufficiently large pressure differential. As another alternative the spiracles may include comb-like structures having a series of fingers that bend to open up further area when subjected to a sufficient pressure differential. The spiracles allow release of pressurized gases that are trapped between the fins and the fuselage during the launch process. This prevents undesired outward movement or bending of the fins when the projectile reaches a muzzle brake during launch, a structure which causes a sudden release of pressure at radially outer locations of the launch tube.

Figure 1:
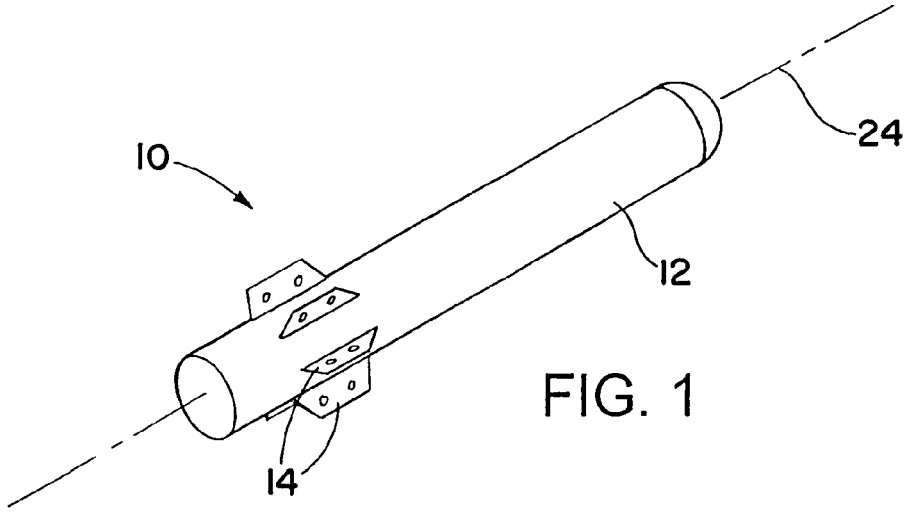
FIG. 1 is an oblique view of a projectile in accordance with an embodiment of the invention.
Figure 2:
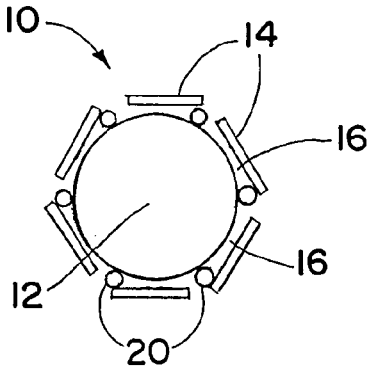
FIG. 2 is an end view of the projectile of FIG. 1, with fins of the projectile in a compact configuration.
Figure 3:
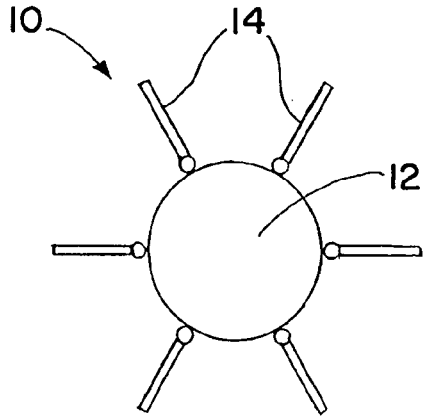
FIG. 3 is an end view of the projectile of FIG. 1 with the fins in a deployed configuration.

Referring initially to FIGS. 1-3, a projectile or missile 10 has a fuselage 12 and a series of fins 14 that are hingedly coupled to the fuselage 12. The fins 14 may be in a compact configuration, shown in FIG. 2, in which the fins 14 are folded up against the fuselage 12, with only captive gas spaces 16 between the fins 14 and the outer surface of the fuselage 12. The compact configuration shown in FIG. 2 allows the projectile 10 to fit into a launch tube or gun having a circular cross section. In the compact configuration the fins 14 may be substantially parallel to a tangent of the cylindrical outer surface of the fuselage 12. Upon exiting the launch tube or gun the fins 14 extend to the deployed or flight configuration shown in FIG. 3. In the deployed configuration the fins 14 may be substantially perpendicular to the outer surface of the fuselage 12.

The fins 14 may be made of steel, or another suitable material. The fuselage 12 and other components in the fuselage 12 may be similar to those of prior projectile designs.

Figure 4:
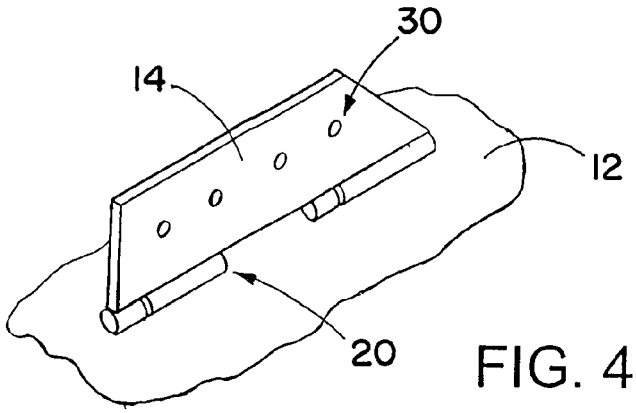
FIG. 4 is a detailed view of part of the projectile of FIG. 1.

With reference now in addition to FIG. 4, the fins 14 are coupled to the fuselage 12 at a series of hinges 20. The hinges 20 may be substantially parallel to an axis 24 of the projectile 10, allowing the fins 14 to rotate from generally parallel to the fuselage 12 (the compact configuration) to generally perpendicular to the fuselage 12 (the deployed configuration). This rotation is about hinge axes that may be substantially parallel to the projectile axis 24. The hinges 20 may have a mechanism, for example a spring, that provides force to extend the fins 14 from the compact configuration to the deployed configuration. Alternatively the fins 14 may be deployed as result of forces on them during flight of the projectile 10. For example spinning of the projectile 10 about its axis 24 may deploy the fins 14 by centrifugal forces.

The hinges 20 may have locks that secure the fins 14 in the deployed positions. The locks may be any of a variety of mechanisms, for example involving one or more pins that engage suitable holes or recesses when the fins 14 reach the deployed positions.

The fins 14 each have one or more spiracles 30, openings that allow pressurized gases to pass through the fins 14 when there is a pressure difference from one side (one major surface) of the fin 14 to the opposite side (opposite major surface). The spiracles 30 may have any of a variety of configurations, only some of which are described below. The spiracles 30 may be open spiracles that always allow flow therethrough, such as by being a series of holes or vias through the fins 14. Alternatively the spiracles 30 be closed spiracles that allow substantially no flow (or only small and/or insignificant flows) at low pressure differences, and that open up to increase flow area at higher pressure differences, allowing more flow therethrough.

Figure 5:
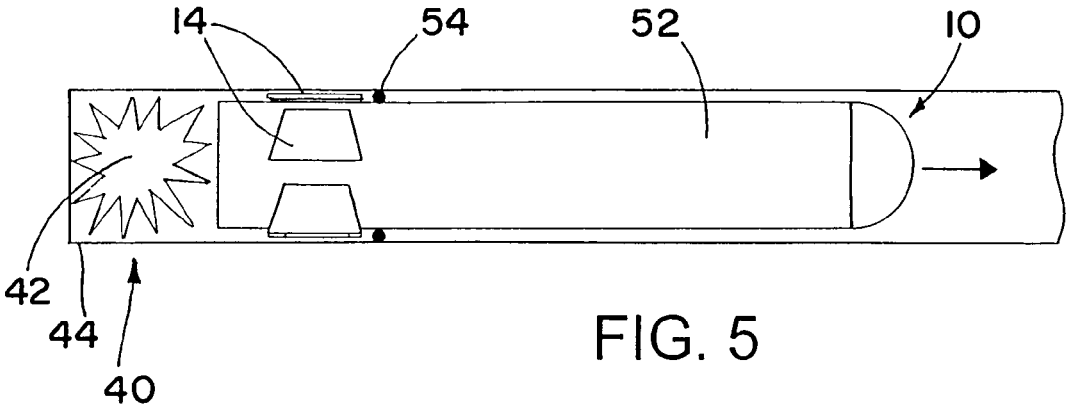
FIG. 5 is a cutaway view of a first step in the launch of the projectile of FIG. 1.

The spiracles 30 solve a problem that occurs during launch of the projectile 10, where the fins 14 receive a sudden pressure difference across them. FIG. 5 illustrates the beginning of a launch process for launching the projectile 10 from a launch tube or gun 40. A propelling charge 42 at a closed end 44 of the launch tube or gun 40 ignites, producing pressurized gases that propel the projectile 10 away from the closed end 44, in the direction of an open end of the launch tube 40. The propelling charge may be separate from the projectile 10, or may be attached to the projectile 10.

Figure 6:
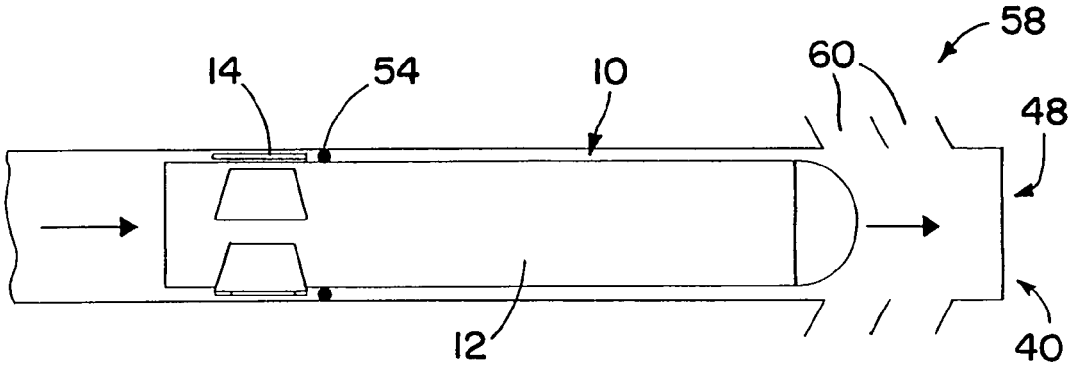
FIG. 6 is a cutaway view of a second step in the launch of the projectile.

FIG. 6 shows a later time in the launch process, with the projectile 10 approaching an open end 48 of the launch tube 40. The projectile 10 has an obturator 54 forward of the fins 14. The obturator 54 is a ring of a relatively soft material, such as copper or plastic, that forms a seal against the wall of the launch tube 40. This keeps pressurized gases behind the projectile 10, providing more force on the projectile 10. Use of an obturator can result in a 10% increase in exit velocity of a missile or other projectile.

A muzzle brake 58 is near the open end 48 of the launch tube 40. The muzzle brake 58 is a series of baffles or openings 60 used to redirect some of the pressurized gasses outward and backwards. This reduces the recoil from the launch of the missile or other projectile 10.

Figure 7:
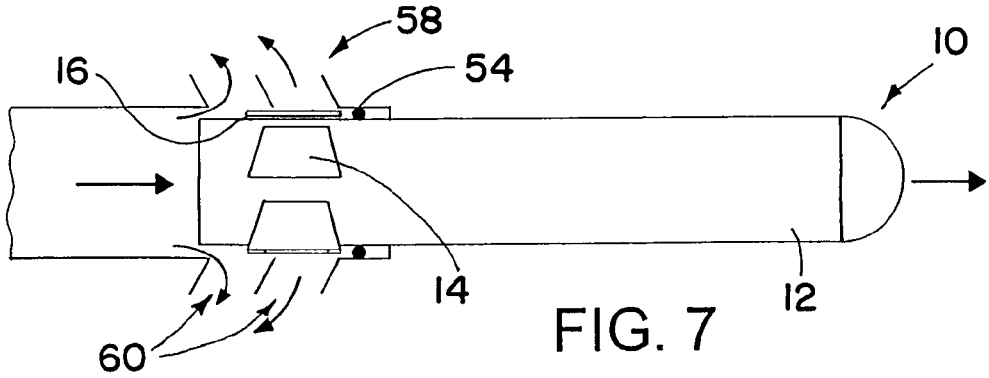
FIG. 7 is a cutaway view of a third step in the launch process.

Referring now to FIG. 7, once the obturator 54 passes the muzzle brake 58 pressurized gasses flow out from the launch tube 40 through the baffles 60. This reduces the pressure outside of the projectile 10. However some pressurized gas is trapped between in the captive gas spaces 16 between fins 14 and the fuselage 12. Although the trapping of pressurized gases in the captive gas spaces 16 is only temporary, it may have serious undesirable effects. The trapped pressurized gases may lead to a significant pressure difference across the faces (major surfaces) of the fins 14. To give example figures, the pressure difference may be from 13.8 MPa (2000 psi) to 68.9 MPa (10,000 psi) or even 82.7 MPa (12,000 psi). Such pressure differences exert considerable forces on the fins 14. For example a fin having dimensions of 15.2 cm (6 inches) by 12.7 cm (5 inches) has an area of 193 $cm^2$ (300 $in^2$). At a pressure difference of 68.9 MPa this results in a force of 1.33 MN (300,000 pounds).

Such a force can bend the fin 14 outward or can cause the fin 14 to push outward, pivoting on the hinge 20. This may bring the tip of the fin 14 into contact with the wall of the launch tube 40. A particular hazard is contact between the fin 14 and the edges of the launch tube 40 surrounding the baffles 60 of the muzzle brake 58. The mechanical stresses on the fins 14 may cause other problems, such as mechanical failure (breakage) of parts of the fins 14. The result may be damaged fins 14 that perform their function inadequately if at all. Damage to the fins 14 may cause complete loss of the projectile 10. In addition, damage to the launch tube or gun 40 may result.

The spiracles 30 provide a solution to the problem of trapped pressurized gases in the captive gas spaces 16. The spiracles 30 allow flow of the gas outward through the fins 14, relieving pressure in the captive gas spaces 16. This results in the reduction or elimination of the potential problems discussed above.

Figure 8:
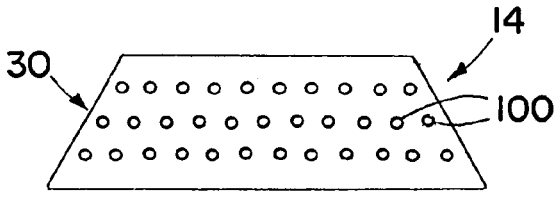
FIG. 8 is a plan view of a fin having a first spiracle arrangement, in accordance with an embodiment of the invention.
Figure 9:
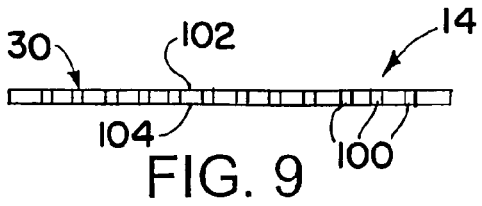
FIG. 9 is a side sectional view of the fin of FIG. 8.

FIGS. 8 and 9 shows one arrangement of the spiracles 30, a series of holes or vias 100 from one face (major surface) 102 of the fin 14 to a second face (major surface) 104 on an opposite side of the fin 14. The vias 100 are shown as circular holes through the fin 14, but alternatively may have other shapes. The vias 100 may be sized so that flow does not become supersonic or otherwise choked at the maximum pressure differences that would be expected to be encountered across the vias 100 (the pressure difference between the pressures at the major surfaces 102 and 104). The holes or vias 100 are sized to prevent choked flow. The size of the holes or vias 100 may be determined by the muzzle exit overpressure used for the launch system.

There may be dozens or even hundreds of the vias 100 on a single fin 14. The vias 100 may be substantially evenly spaced on the fin 14.

Figure 10:
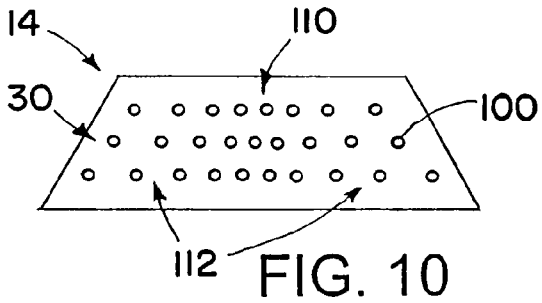
FIG. 10 is a plan view of a fin having a second spiracle arrangement, in accordance with an embodiment of the invention.
Figure 11:
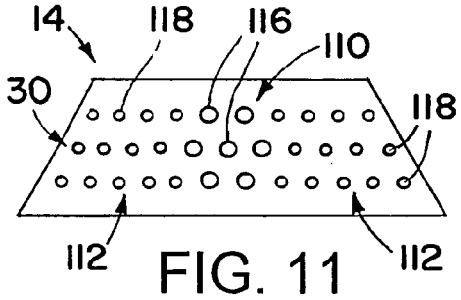
FIG. 11 is a plan view of a fin having a third spiracle arrangement, in accordance with an embodiment of the invention.

As an alternative, shown in FIG. 10, the vias 100 may be more closely spaced at a center fin portion 110 than at an edge fin portion 112 that surrounds the center fin portion 110. The center fin portion 110 is where the highest gas pressures are expected after the obturator 54 (FIG. 4) passes the muzzle brake 58 (FIG. 4). Therefore more vias 100 in the central fin portion 110 may lead to better performance. As another alternative, flow through the central fin portion 110 may be enhanced by providing larger vias 116 in the central fin portion 110, and smaller vias 118 in the edge fin portion 112. This further alternative is shown in FIG. 11.

Figure 12:
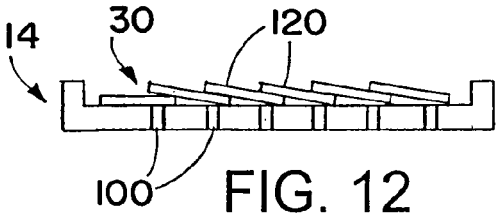
FIG. 12 is a side section view of a fin having a fourth spiracle arrangement, in accordance with an embodiment of the invention.

FIG. 12 shows yet another variant, where the vias 100 have flaps 120 that cover them at small pressure differences across the fins 14. The flaps 120 may cover single holes or vias 100, or may each cover groups of holes or vias 100. As is shown in FIG. 12, the flaps 120 may overlap one another like scales, to aid in preventing undesired flow through the vias 100 when there is only a small pressure difference, such as a pressure difference below a predetermined threshold. It will be appreciated that the flaps 120 may be used with any of the via configurations of FIGS. 8-11.

Figure 13:
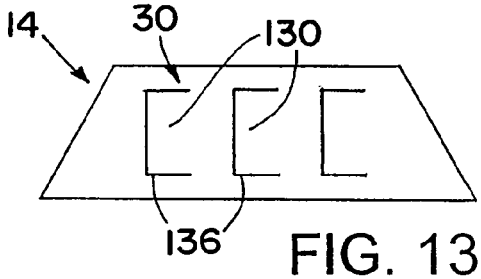
FIG. 13 is a plan view of a fin having a fifth spiracle arrangement, in accordance with an embodiment of the invention.
Figure 14:
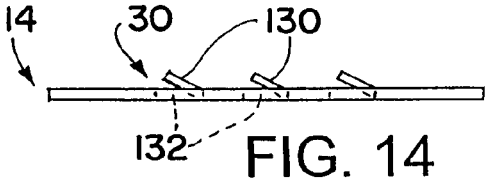
FIG. 14 is a side view showing the fin of FIG. 13 in an open configuration.

FIG. 13 shows another type of spiracle 30, a flap plate 130 the covers an opening 132 when the pressure difference across the fin 14 is small. The flap plate 130 deforms as the pressure difference increases, increasing the area opening 132 and allowing flow therethrough, as shown in FIG. 14. The flap plate 130 may be rectangular, or may have another suitable shape. The flap plate 130 may be a unitary part of the fin 14, formed as part of a monolithic unitary single piece with the other parts of the fin 14. A slit 136 may be used to separate sides of the flap plate 130 from the other parts of the fin 14. The flap plate 130 may be a thinned portion of the fin 14, and/or may have a weakened portion, such as a thinned portion, that allows preferential bending of the flap plate 130 at that location.

The flap 14 may have multiple flap plates 130 covering multiple openings 132. The multiple flap plate 130 and multiple openings 132 may all be identical to one another, or alternatively may different from one another in size and/or shape.

Figure 15:
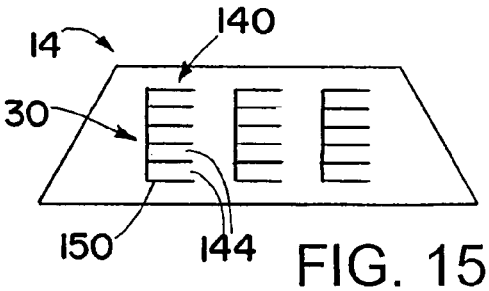
FIG. 15 is a plan view of a fin having a sixth spiracle arrangement, in accordance with an embodiment of the invention.
Figure 16:
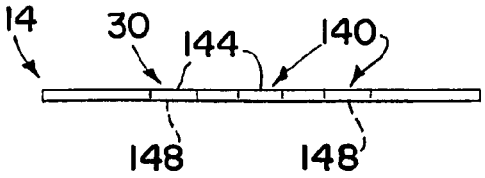
FIG. 16 is a side view showing the fin of FIG. 15 in a closed configuration.
Figure 17:
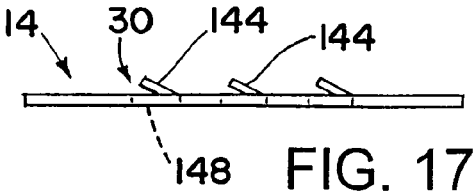
FIG. 17 is a side view showing the fin of FIG. 16 in an open configuration.

FIGS. 15-17 show another type of spiracle 30, a comb 140 have multiple fingers 144 that are substantially parallel from one another, and are able to bend individually or in a group to open all or a part of an opening or passage 148 covered by the fingers 144. A slit 150 separates the fingers 144 from each other, and from parts of the rest of the fin 14. Alternatively adjacent of the fingers 144 may overlap. FIG. 16 shows the comb 140 in a substantially closed configuration, while FIG. 17 shows the comb 140 in an open configuration, allowing the flow through the opening or passage 148.

The fingers 144 may all be attached to the same side of the opening or passage 148, as shown in the FIG. 15. Alternatively the fingers may be attached on different sides of the opening or passage 148. For example the adjacent of the fingers 144 may be attached to opposite sides of the fin 14, producing an array of interdigitated fingers. The fin 14 may have multiple combs 140 which may be substantially identical in size or shape, or alternatively may have differences in size and/or shape.

The closable spiracles shown in FIGS. 12-17 may have substantially no flow through their openings when the pressure difference across them is below a certain threshold. The pressure threshold may be set by configuring the closable spiracles, for example by choosing the dimensions, thickness, and other features of the coverings for the openings. The threshold pressure difference may be about 3.4 MPa (500 psi). This keeps the openings substantially closed during normal aerodynamic maneuvers, for example with pressure differences of 0.68 MPa (100 psi) or less across the fins. At pressure differences in excess of higher threshold, the openings of the spiracles 30 may be fully open. The pressure difference across the fins from the muzzle exit overpressures may be around 13.8 MPa (2000 psi) to 82.7 MPa (12,000 psi).

The use of the spiracles 30 may be combined with other measures to reduce the effect of trapped pressurized gas on the fins 14. For example solid material may be placed in the captive gas spaces 16 to reduce the volume of pressurized gas trapped there. A concurrently-filed application, "Projectile With Filler Material Between Fins And Fuselage," 12/257,699, which is incorporated herein in its entirety, describes the placement of lightweight material, such as plastic or closed foam, in space between hinged fins and a projectile fuselage. Such lightweight material may fall off naturally as the fins open up after the projectile has left a launch tube or gun from which it is fired.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A projectile comprising:

a fuselage; and fins hingedly coupled to the fuselage;

wherein each of the fins has one or more spiracles in them to allow pressurized gasses to pass through a thickness of the fin;

wherein the fins are initially in a compact configuration, with captive gas spaces between the fins and an outer surface of the fuselage; and wherein, when the fins are in the compact configuration, the spiracles allow flow of gas outward through the fins, to relieve pressure in the captive gas spaces.

2. The projectile of claim 1, wherein the spiracles are always open.

3. The projectile of claim 1, wherein the spiracles are substantially closed when the pressure difference across the spiracles is less than a threshold pressure difference.

4. The projectile of claim 3, wherein the threshold pressure difference is 3.4 MPa (500 psi).

5. The projectile of claim 1, wherein for each fin the one or more spiracles include a plurality of vias.

6. The projectile of claim 5, wherein the vias have circular cross sections.

7. The projectile of claim 5 or claim 6, wherein the vias are covered by flaps.

8. The projectile of claim 7, wherein the flaps are overlapping.

9. The projectile of claim 1, wherein at least some of the spiracles include flaps that cover openings.

10. The projectile of claim 9, wherein the flaps are formed as parts of the fins, as single monolithic pieces with other parts of the fins.

11. The projectile of claim 10, wherein the flaps are substantially rectangular.

12. The projectile of claim 1, wherein at least some of the spiracles include comb structures having multiple substantially-parallel fingers.

13. The projectile of claim 1, wherein, when the fins are in the compact configuration, the fins are substantially parallel to a tangent of the outer surface of the fuselage.

14. The projectile of claim 1, wherein, when the fins are in a deployed configuration, the fins are substantially perpendicular to the outer surface of the fuselage.

15. The projectile of claim 1, wherein, when the fins are in a deployed configuration, the spiracles are substantially perpendicular to a projectile axis of the projectile.

16. A method of launching a projectile, the method comprising:

providing the projectile having a fuselage and fins hingedly coupled to the fuselage, in a launch tube, with the fins in a compact configuration, folded against the fuselage;

applying pressurized gases to a back end of the projectile, driving the projectile forward in the launch tube; and relieving pressurized gases in a space between the fins and the fuselage when the projectile reaches a muzzle brake of the launch tube.

17. The method of claim 16, wherein the relieving includes passing the pressurized gases through spiracles in the fins.

18. The method of claim 17, wherein the passing includes elastically deforming flaps of the fins because of a pressure difference between major surfaces of the fins.

19. The method of claim 17, wherein the spiracles are plural holes (vias) through each of the fins.

20. The method of claim 17, wherein the spiracles are comb structures in each of the fins.

21. The method of claim 17, wherein the spiracles do not pass substantially any gasses therethrough at aerodynamic pressure differences across the fins.

* * * * *